US012473794B2

(12) United States Patent
Varghese et al.

(10) Patent No.: US 12,473,794 B2
(45) Date of Patent: Nov. 18, 2025

(54) WIRELINE PLUGS FOR USE IN A Y-TOOL

(71) Applicant: Schlumberger Technology Corporation, Sugar Land, TX (US)

(72) Inventors: Mathew Varghese, Abu Dhabi (AE); Jared Mangum, Richmond, TX (US); Joseph Varkey, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/429,664

(22) Filed: Feb. 1, 2024

(65) Prior Publication Data

US 2024/0254855 A1 Aug. 1, 2024

Related U.S. Application Data

(60) Provisional application No. 63/482,695, filed on Feb. 1, 2023.

(51) Int. Cl.
*E21B 33/12* (2006.01)
*E21B 34/14* (2006.01)

(52) U.S. Cl.
CPC ..... *E21B 33/1208* (2013.01)

(58) Field of Classification Search
CPC ..... E21B 33/12; E21B 34/14; E21B 33/1208
USPC ..... 166/378
See application file for complete search history.

(56) References Cited

U.S. PATENT DOCUMENTS 4,637,460 A * 1/1987 McGlothen ..... E21B 33/122 166/189
5,099,919 A * 3/1992 Schneider ..... E21B 33/10 166/324
5,579,841 A * 12/1996 Schneider ..... E21B 34/14 166/135
5,894,104 A * 4/1999 Hedberg ..... H01B 7/046 174/36
11,387,014 B2 * 7/2022 Varkey ..... H01B 7/1895

* cited by examiner

*Primary Examiner* — Nicole Coy
*Assistant Examiner* — Douglas S Wood
(74) *Attorney, Agent, or Firm* — Jeffrey D. Frantz

(57) ABSTRACT

Wireline plugs for use in a Y-tool. In some embodiments, the wireline plug can include an elongated body defining a bore therethrough. A first end of the elongated body can include an outer surface configured to serve as a fishing neck and a second end configured to connect to a downhole tool. The wireline plug can include an elongated seal defining a bore therethrough disposed within a portion of the bore defined by the elongated body. The elongated seal can be configured to provide an at least partial fluid seal between an inner surface of the bore defined by the elongated body and an outer surface of a wireline when disposed within the bore defined by the elongated seal. The elongated seal can be formed from a polymer, an elastomer, or a combination of a polymer and an elastomer.

18 Claims, 3 Drawing Sheets

WIRELINE PLUGS FOR USE IN A Y-TOOL

CROSS REFERENCE TO RELATED APPLICATION

This application claims priority to U.S. Provisional Patent Application No. 63/482,695, filed on Feb. 1, 2023, which is incorporated by reference herein.

FIELD

Embodiments described generally relate to Y-tools that can be installed on production tubing in downhole wells. More particularly, such embodiments relate to wireline plugs for use in a Y-tool and processes for assembling same.

BACKGROUND

In a well where the reservoir pressure is insufficient to cause fluids to flow from the formation into the wellbore, a pumping arrangement (often abbreviated as ESP: Electrical Submersible Pump) can be used to raise fluids to the surface. Fluid can enter the wellbore below the pumping arrangement. Above the pump, the fluid flows usually in production tubing that channels the pumping arrangement output to the surface. It is often necessary to perform production logging data acquisition below the pumping arrangement, as this is where the fluid is entering the wellbore. Such a pumping arrangement, however, represents a mechanical obstacle to lowering a logging tool into the wellbore.

One common technique used to enable logging below the pumping arrangement includes a branch installed in the production tubing known as a "Y-tool". The pumping arrangement can be disposed in a first one of the branches of the Y-tool and a plug can be disposed in a second one of the branches of the Y-tool. The plug can be removed and the logging tool suspended from a wireline can be lowered through the second branch and below the pumping arrangement. Another plug or "wireline plug" defining a bore therethrough can be disposed about the wireline that can engage with the second branch to seal the second branch and prevent fluids from flowing therethrough. Conventional wireline plugs, however, damage the outer surface of the wireline as the logging tool is raised and lowered within the wellbore due to frictional forces as the wireline moves back and forth through the wireline plug when the logging tool is raised and lowered within the wellbore.

There is a need, therefore, for improved wireline plugs for use in a Y-tool and processes for assembling same.

SUMMARY

Wireline plugs for use in a Y-tool and processes for assembling same are provided. In some embodiments, the wireline plug can include an elongated body that can define a bore therethrough. A first end of the elongated body can include an outer surface configured to serve as a fishing neck and a second end that can be configured to connect to a downhole tool. The wireline plug can also include an elongated seal that can define a bore therethrough that can be disposed within a portion of the bore defined by the elongated body. The elongated seal can be configured to provide an at least partial fluid seal between an inner surface of the bore defined by the elongated body and an outer surface of a wireline when disposed within the bore defined by the elongated seal. The elongated seal can be formed from a polymer, an elastomer, or at least a first section of the elongated seal can be formed from a polymer and at least a second section of the elongated seal can be formed from an elastomer.

In some embodiments, a process for assembling a wireline plug can include installing an elongated seal within a bore defined by an elongated body. A first end of the elongated body can include an outer surface configured to serve as a fishing neck and a second end configured to connect to a downhole tool. The elongated seal can define a bore therethrough. The elongated seal can be located within a portion of the bore defined by the elongated body. The elongated seal can be configured to provide an at least partial fluid seal between an inner surface of the bore defined by the elongated body and an outer surface of a wireline when disposed within the bore defined by the elongated seal. The elongated seal can be formed from a polymer, an elastomer, or at least a first section of the elongated seal can be formed from a polymer and at least a second section of the elongated seal can be formed from an elastomer.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions can be made to achieve certain goals, such as compliance with system-related and/or operation-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain examples commensurate in scope with the claimed subject matter are discussed below. These examples are not intended to limit the scope of the disclosure. Indeed, the present disclosure may encompass a variety of forms that may be similar to or different from the examples set forth below.

It should be understood that the formation of a first feature about, over, or on a second feature in the description that follows includes embodiments in which the first and second features are formed in direct contact and also includes embodiments in which additional features are formed interposing the first and second features, such that the first and second features are not in direct contact or directly adjacent to one another. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Figure 1:
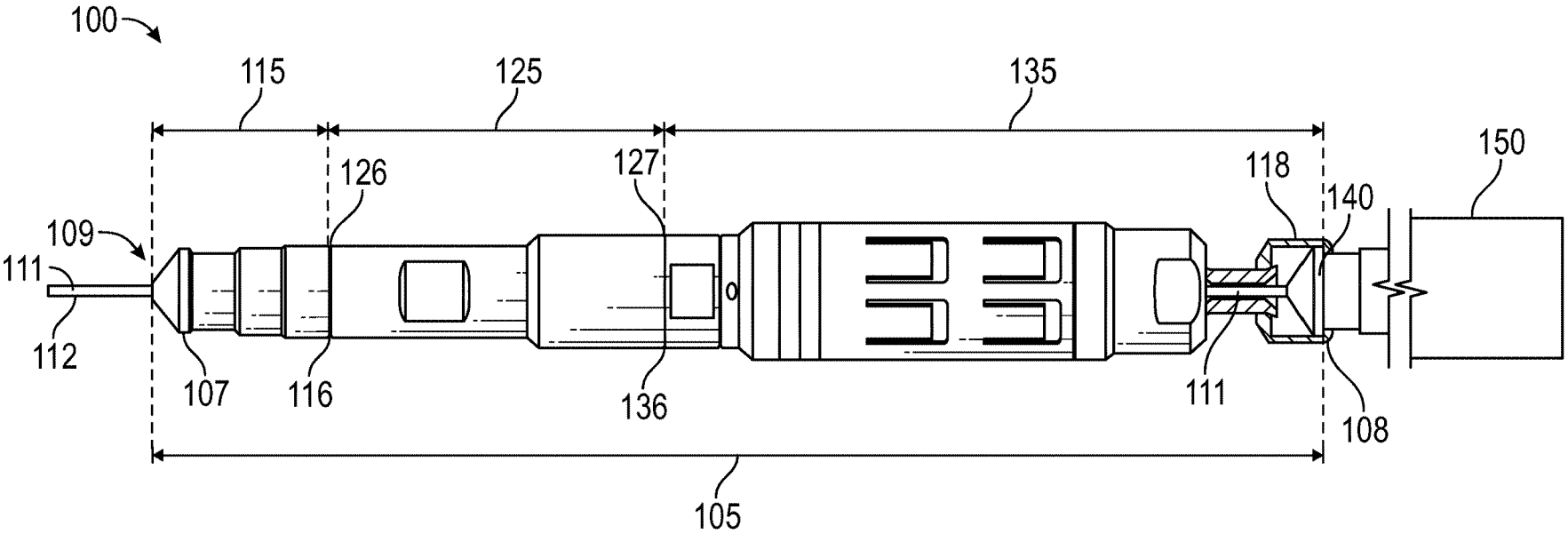
FIG. 1 depicts an illustrative wireline plug configured to be disposed within a Y-tool, according to one or more embodiments described.

FIG. 1 depicts an illustrative wireline plug 100 configured to be disposed within a Y-tool (not shown), according to one or more embodiments. The wireline plug 100 can include an elongated body 105 that can define a bore 109 therethrough. As shown, a wireline 111 can be disposed through the bore 109 defined by the elongated body 105. In some embodiments, the elongated body 105 can be formed from one section or two or more sections that can be serially coupled to one another. As shown, the elongated body 105 can be formed by serially coupling a first section 115, a second section 125, and a third section 135 to one another. It should be understood, however, that any number of separate or otherwise discrete sections or components can be coupled to one another to form the elongated body 105. The various exterior and interior profiles and configurations of wireline plugs that can be used in Y-tools are well-known to those skilled in the art.

An outer surface of the first end 107 of the elongated body 105, i.e., the outer surface of the first end of the first section 115, can be configured to serve as a fishing neck or other coupling apparatus. A second end 116 of the first section 115 can be coupled to a first end 126 of the second section 125. A second end 127 of the second section 125 can be coupled to a first end 136 of the third section 135 to form the elongated body 105. As such, the second end 108 of the elongated body 105 can also be the second end of the third section 135. The second end 108 of the elongated body can be configured to connect to a downhole tool, e.g., a stimulation tool and/or a logging tool, 150. For example, as shown, the second end 108 of the elongated body can be configured to connect to a fishing neck 140 coupled to the downhole tool 150 via a receiving sleeve 118.

As further described below with regard to FIGS. 2-4, an elongated seal (210, 310, 410) that can define a bore (211, 311, 411, respectively) therethrough can be disposed within at least a portion of the bore 109 defined by the elongated body 105. The elongated seal (210, 310, 410) can be configured to provide an at least partial fluid seal between an inner surface 110 of the bore 109 defined by the elongated body 105 and an outer surface 112 of the wireline 111 when the wire line 111 is disposed within the bore (211, 311, 411) defined by the elongated seal. The outer surface 112 can be an outer jacket surface of the wireline 111. In some embodiments, the elongated seal (210, 310, 410) can provide a complete fluid seal between the inner surface 110 of the bore 109 and the outer surface 112 of the wireline 111. In other embodiments, the elongated seal (210, 310, 410) can provide a partial fluid seal between the inner surface 110 of the bore 109 and the outer surface 112 of the wireline 111 such that a fluid (gas and/or liquid) can pass through the elongated body 105 at a predetermined rate to allow pressure across the elongated body 105 to be equalized or to at least move closer to an equalized pressure across the elongated body 105 as compared to if the elongated seal (210, 310, 410) provided a complete fluid seal.

The outer jacket or surface 112 of the wireline 111 can be formed from any suitable polymer or elastomer. In some embodiments, the wireline 111 can be a polymer locked cable. In some embodiments, illustrative polymers the outer jacket of the wireline 111, i.e., the outer surface 112 of the wireline 111, can be formed from can be or can include, but are not limited to, a polyolefins, a polyether ether ketone, a polyaryl ether ketone, a polyphenylene sulfide polymer, an ethylene-tetrafluoroethylene polymer, a poly(1,4-phenylene) polymer, a polytetrafluoroethylene, a perfluoroalkoxy polymer, a fluorinated ethylene propylene polymer, a perfluoromethoxy polymer, other suitable polymeric materials, and any combination thereof. In some embodiments, the polymer can also include wear resistance particles and/or short fibers, e.g., carbon fibers or glass fibers. In some embodiments, the polymer used to form the outer jacket of the wireline 111 can be a carbon-fiber-reinforced ETFE (ethylene-tetrafluoroethylene) fluoropolymer. In some embodiments, the wireline 111 can include the wireline cables described in U.S. Pat. No. 11,387,014.

The elongated body 105 can be formed from one or more metals or metal alloys. As such, the first section 115, the second section 125, and the third section 135 can be formed from steel, nickel, copper, titanium, chromium, molybdenum, tungsten, vanadium, any other suitable metal, or any alloy thereof. As such, the inner surface 110 of the bore 109 defined by the elongated body 109 can be formed or otherwise composed of a metal or metal alloy. Such metal surface can damage the outer jacket or outer surface 112 of the wireline 111 can be damaged by frictional forces from the metal surface generated when the wireline 111 moves through the bore 109 defined by the elongated body. The elongated seal (210, 310, 410) can reduce or prevent damage to the outer surface 112 of the wireline 111 as the wireline 111 moves through the bore 109 defined by the elongated body 109.

Figure 2:
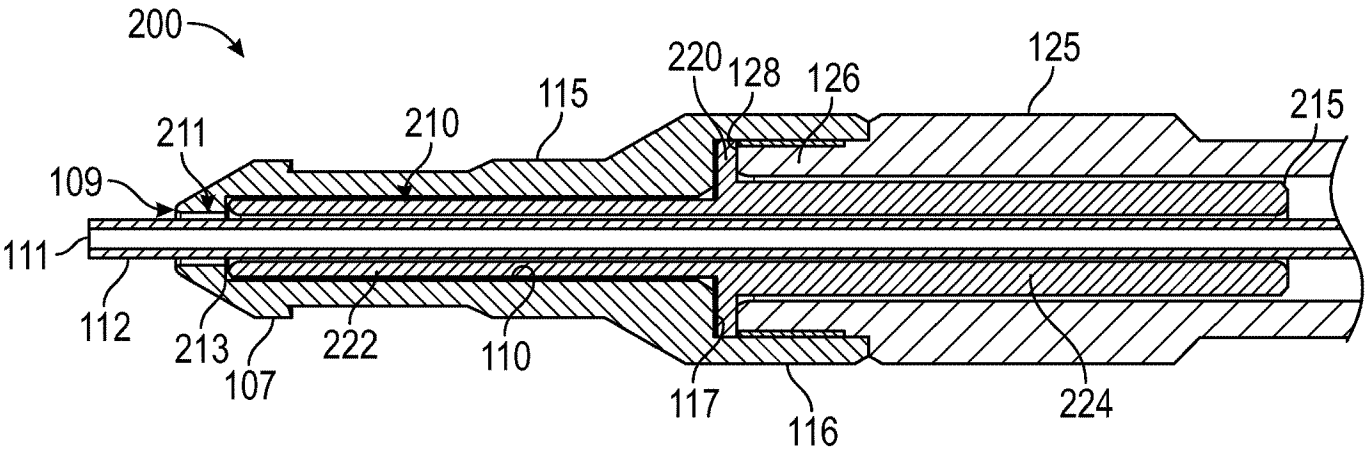
FIG. 2 depicts a partial cross-sectional view of an illustrative wireline plug that includes an elongated seal formed from a polymer disposed therein, according to one or more embodiments described.

FIG. 2 depicts a partial cross-sectional view of an illustrative wireline plug 200 that includes an elongated seal 210 formed from a polymer disposed within the bore 109 defined by the elongated body 105, according to one or more embodiments. A first end 213 of the elongated seal 210 can be located within the first section 115 of the elongated body 105 between the inner surface or wall 110 of the bore 109 and the outer surface 112 of the wireline 111. A second end 215 of the elongated seal 210 can be located within the second section 125 of the elongated body 105 between the inner wall 110 of the bore 109 and the outer surface of the wireline 111. The bore 211 defined by the elongated seal 210 can extend through the elongated seal 210 from the first end 213 to the second end 215 of the elongated seal 210.

In some embodiments, the elongated seal 210 can include a wall 220 that can extend radially from a longitudinal axis of the elongated seal 210 between the first end 213 and the second end 215 of the elongated seal 210. In some embodiments, at least a portion of the wall 220 can be disposed between an inner wall 117 of the first section 115 of the elongated body 105 and the first end 126 of the second section 125 of the elongated body 105. As shown, the inner wall 117 of the first section 115 can be substantially perpendicular to a longitudinal axis of the first section 115 and the first end 126 can also include a surface 128 that can be substantially perpendicular to a longitudinal axis of the second section 125, but such configuration is not required. By at least partially disposing the wall 220 between the inner wall 117 of the first section 115 and the first end 126 of the second section 125, the likelihood the elongated seal 210 will longitudinally move within the bore 109 defined by the elongated body 105 can be reduced or prevented when the wireline 111 moves through the elongated seal 210. In some embodiments, the wall 220 can be a circumferential wall that extends about the circumference of the elongated seal 210. In other embodiments, the wall 220 can be composed of one or more sections or "tabs" that can extend radially from the longitudinal axis of the elongated seal 210.

As also shown in FIG. 2, in some embodiments a wall thickness of a section 222 of the elongated seal 210 located between the first end 213 of the elongated seal 210 and the circumferential wall 220 can be less than a wall thickness of a section 224 of the elongated seal 210 located between the circumferential wall 220 and the second end 215 of the elongated seal 210. It should be understood, however, that the wall thickness of the elongated seal 210 can be substantially the same from the first end 213 to the second end 215. It should also be understood that the wall thickness of the section 222 of the elongated seal 210 between the first end 213 of the elongated seal 210 and the circumferential wall 220 can be greater than the wall thickness of the section 224 of the elongated seal 210 located between the circumferential wall 220 and the second end 215 of the elongated seal 210. The wall thickness of the elongated seal 210 at any given point between the first and second ends 213, 215 thereof can depend, at least in part, on the inner diameter of the bore 109 defined by the elongated body 105. In the embodiments, as shown in FIGS. 2-4, the inner diameter of the bore 109 defined by the elongated body 105 within the first section 115 can be less than the inner diameter of the bore 109 defined by the elongated body 105 within the second section 125. In other embodiments, however, the inner diameter of the bore 109 can be substantially constant throughout. In such embodiment, the wall thickness of the elongated seal 210 between the first end 213 of the elongated seal 210 and the circumferential wall 220 can be substantially the same as the wall thickness of the elongated seal 210 located between the circumferential wall 220 and the second end 215 of the elongated seal 210. In still other embodiments, the inner diameter of the bore 109 defined by the elongated body 105 within the first section 115 can be greater than the inner diameter of the bore 109 defined by the elongated body 105 within the second section 125. In such embodiment, the wall thickness of the elongated seal 210 between the first end 213 of the elongated seal 210 and the circumferential wall 220 can be greater than the wall thickness of the elongated seal 210 located between the circumferential wall 220 and the second end 215 of the elongated seal 210.

Figure 3:
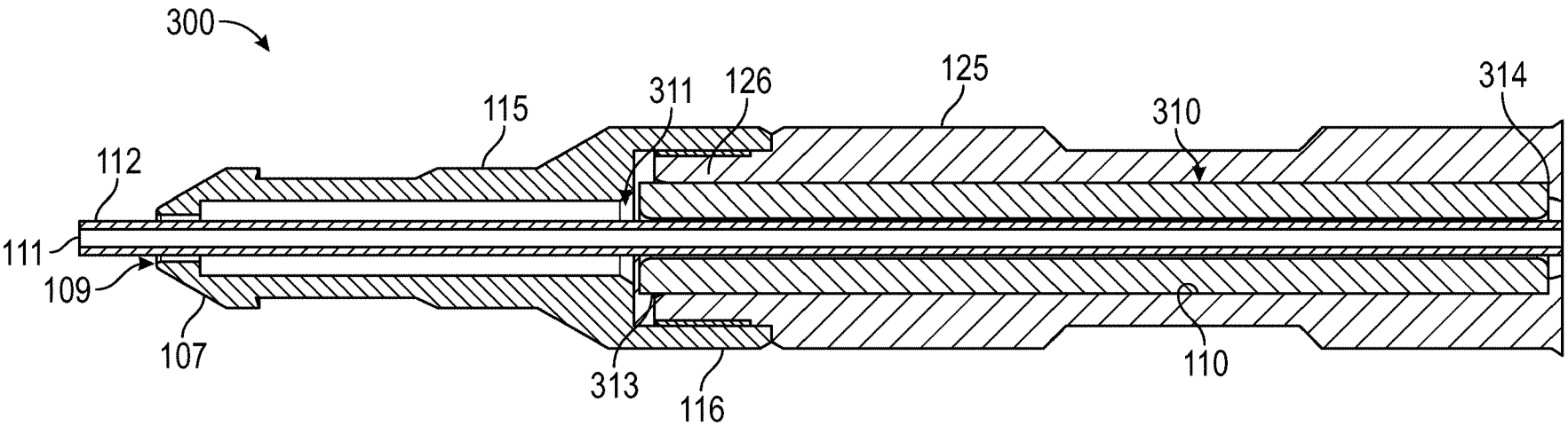
FIG. 3 depicts a partial cross-sectional view of an illustrative wireline plug that includes an elongated seal formed from an elastomer disposed therein, according to one or more embodiments described.

FIG. 3 depicts a partial cross-sectional view of an illustrative wireline plug 300 that includes an elongated seal 310 formed from an elastomer disposed within the bore 109 defined by the elongated body 105, according to one or more embodiments. In some embodiments, as shown in FIG. 3, a first end 313 of the elongated seal 310 can be located between the inner wall 117 of the first section 115 of the elongated body 105 and the surface 128 of the first end 126 of the second section 125 of the elongated body 105 and a second end 314 of the elongated seal 310 can be located within the second section 125 of the elongated body 105. The bore 311 defined by the elongated seal 310 can extend through the elongated seal 310 from the first end 313 to the second end 314 of the elongated seal 310.

The elongated seal 310 formed from the elastomer can be or can include a single seal or can be or can include split seals. In some embodiments, the elongated seal 310 can exert a radial force against the inner wall 110 of the bore 109 that can be sufficient to reduce or prevent movement of the elongated seal 310 from moving within the bore 109 as the wireline 111 moves therethrough. It should also be noted, as shown in FIG. 3 and described above with reference to FIG. 2, the inner diameter of the bore 109 within the second section 125 can be greater than the inner diameter of the bore 109 within the first section 115. As such, the outer diameter of the elongated seal 310 within the second section can be greater than the inner diameter of the bore 109 within the first section 115 such that the inner wall 117 of the first section 115 can act as a stop for the elongated seal 310 that can prevent the elongated seal 310 from moving into the bore 109 within the first section 115. It should also be understood that an inner wall similar to the inner wall 117 can be located toward the second end 127 of the second section 125 that can also act as a stop for the elongated seal 310 that can prevent the elongated seal 310 from moving into the bore 109 within the third section 135 of the elongated body 105.

Figure 4:
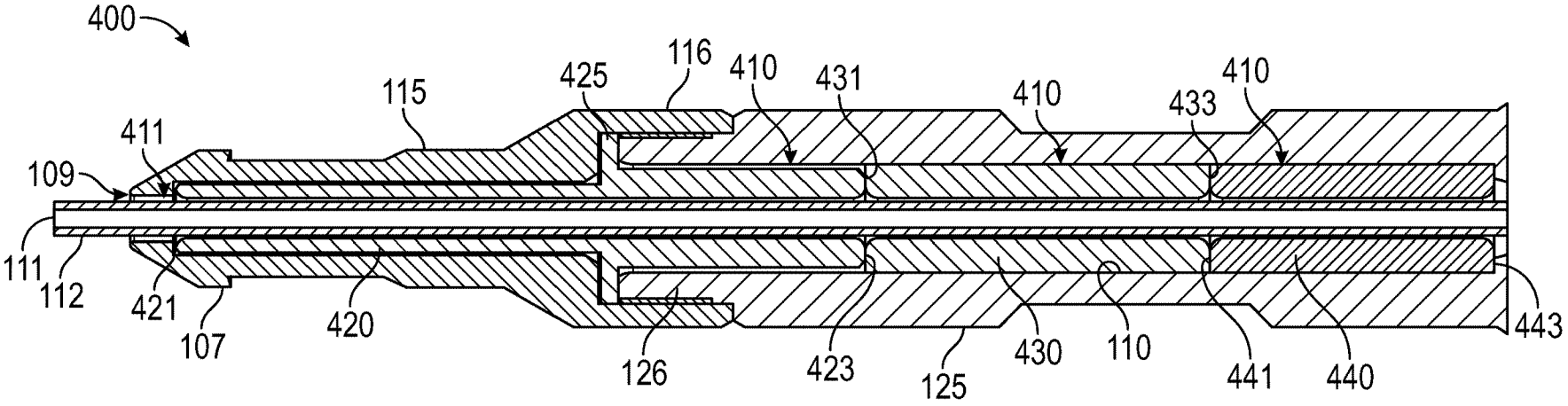
FIG. 4 depicts a partial cross-sectional view of an illustrative wireline plug that includes an elongated seal that includes at least one section formed from a polymer and at least one section formed from an elastomer, according to one or more embodiments described.

FIG. 4 depicts a partial cross-sectional view of an illustrative wireline plug 400 that includes an elongated seal 410 that includes at least one section (two are shown, 420, 440) formed from a polymer and at least one section (one is shown, 430) formed from an elastomer, according to one or more embodiments. As shown in FIG. 4, the overall configuration or shape of the elongated seal 410 can be substantially similar to the overall configuration or shape of the elongated seal 210. The main difference between the elongated seal 210 and the elongated seal 410 is that the elongated seal 410 includes three separate sections, namely, the first section 420 formed from a polymer, the second section 430 formed from an elastomer, and the third section 440 formed from a polymer. The polymer used to form the first section 420 and the polymer used to form the third section 440 can be the same or different. In some embodiments the elongated seal 410 can include any number of separate sections that can be serially aligned with one another within the bore 109 defined by the elongated body 105 to form the elongated seal 410. The bore 411 defined by the elongated seal 410 can extend through the elongated seal 410 from a first end 421 to a second end 443 of the elongated seal 410.

As shown in FIG. 4, a first portion of the first section 420 of the elongated seal 410 can be located within the first section 115 of the elongated body 105 and a second portion of the first section 420 of the elongated seal can be located within the second section 125 of the elongated body 105. The second section 430 and the third section 440 of the elongated seal 410 can be located within the second section 125 of the elongated body 105.

The first end 421 of the elongated seal 410 can also be the first end of the first section 420 of the elongated seal 410 can be located within the first section 115 of the elongated body 105 between the inner surface or wall 110 of the bore 109 and the outer surface 112 of the wireline 111. A second end 423 of the first section 420 of the elongated seal 410 can be located within the second section 125 of the elongated body 105 between the inner wall 110 of the bore 109 and the outer surface 112 of the wireline 111. In some embodiments, the first section 420 of the elongated seal 410 can include a wall 425 that can extend radially from a longitudinal axis of the first section 420 of the elongated seal 410 between the first end 421 and the second end 423 of the first section 420 of the elongated seal 410. The wall 425 can be the same or substantially similar to the wall 220 described above with reference to FIG. 2.

A first end 431 of the second section 430 of the elongated seal 410 can be adjacent to the second end 423 of the first section 420 of the elongated seal 410. A second end 433 of the second section 430 of the elongated seal 410 can be adjacent a first end 441 of the third section 440 of the elongated seal 410. The second end 443 of the elongated seal 410 can also be the second end of the third section 440 of the elongated seal 410 and can be located within the second section 125 of the elongated body 105 and oriented toward the third section 135 of the elongated body 105.

It should be understood that the elongated seals 210, 310, and 410, while being described as being formed from a polymer (elongated seal 210), an elastomer (elongated seal 310), or a combination of a polymer section, an elastomer section, and a polymer section (elongated seal 410), the elongated seal 210 can instead be formed from an elastomer, the elongated seal 310 can instead be formed from a polymer, and the elongated seal 410 can instead be made with the first section 420 formed from an elastomer, the second section 430 formed from a polymer, and the third section 414 formed from an elastomer, where the elastomers in the first and third sections 420, 440 can be the same or different with respect to one another.

The polymer that can be used to make the elongated seals 210, 310, and 410 is a macromolecule that is composed of a large number of repeating units. The repeating units represent monomers (small molecules) from which the polymer was made. The monomers have either double bonds or at least two functional groups per molecule that The elastomer that can be used to make the elongated seals 210, 310, and 410 is a type of polymer that possesses elasticity. Elasticity is the ability of a material to resume its normal shape after being subjected to stretching or compression. Elastomers are rubber-like material and are usually amorphous polymers. Elastomers typically have some degree of cross-linking, which allows the monomers to undergo polymerization to produce the elastomer.

The polymer used to make the elongated seals 210, 310, and 410 or any portion or section thereof can include any suitable polymer capable of providing an at least partial fluid seal between the inner surface 110 of the bore 109 defined by the elongated body 105 and the outer surface 112 of the wireline 111 when disposed within the bore 211, 311, 411 defined by the elongated seals 211, 311, 411, respectively. In some embodiments, the polymer used to make the elongated seals 210, 310, and 410 or any portion or section thereof can be or can include, but is not limited to, a virgin polyether ether ketone (virgin PEEK), a carbon-fiber-reinforced polyether ether ketone (CFR-PEEK), glass fiber reinforced polyether ether ketone (GFR PEEK), or a lubricated polyether ether ketone. In some embodiments, suitable lubricated polyether ether ketone can include one or more additives, e.g., carbon fiber, graphite, a polytetrafluoroethylene polymer, molybdenum disulfide, tungsten disulfide, and/or any other suitable additive(s) that can be incorporated into the polymer to provide a self-lubricating polymer. In other embodiments, the lubricated polyether ether ketone can be lubricated via application of a lubricant, e.g., an oil, a grease, silicone, a perfluoropolyether (PFPE), a multiply-alkylated cyclopentane, or the like. In some embodiments, other suitable polymers can be or can include, but are not limited to, a polyolefin polymer, a polyaryl ether ketone polymer, a polyphenylene sulfide polymer, an ethylene-tetrafluoroethylene polymer, a poly(1,4-phenylene) polymer, a polytetrafluoroethylene polymer, a perfluoroalkoxy polymer, a fluorinated ethylene propylene polymer, a perfluoromethoxy polymer, other suitable polymeric materials, and any combination thereof.

The elastomer used to make the elongated seals 210, 310, and 410 or any portion or section thereof can include any suitable elastomer capable of providing an at least partial fluid seal between the inner surface 110 of the bore 109 defined by the elongated body 105 and the outer surface 112 of the wireline 111 when disposed within the bore 211, 311, 411 defined by the elongated seals 211, 311, 411, respectively. In some embodiments, the elastomer used to make the elongated seals 210, 310, and 410 or any portion or section thereof can be or can include, but is not limited to, hydrogenated acrylonitrile butadiene rubber (HNBR), and/or a fluorocarbon-based fluoroelastomer. Suitable fluorocarbon-based fluoroelastomers can be or can include one or more of the fluorocarbon-based fluoroelastomers defined by ASTM D1418-22 that are commonly referred to as fluorine rubber or fluoro-rubber. In some embodiments, other suitable elastomers can be or can include, but are not limited to, a polychloroprene elastomer, e.g., neoprene; a fluorocarbon or fluoro-elastomer, e.g. VITON®, perfluoro-elastomer, tetrafluoro ethylene/propylene rubber, a fluorosilicone rubber, a nitrile butadiene rubber, a saturated nitrile butadiene rubber, a silicone rubber, a polyurethane elastomer, or any combination thereof. In some embodiments, suitable elastomers can include the elastomers classified under ASTM D1418-22 as NBR, VMQ, CR, FKM, FFKM, HNBR, FVMQ, and/or AU.

The FKM elastomers can be classified under one of five types. Type 1 FKMs are composed of vinylidene fluoride (VDF) and hexafluoropropylene (HFP) and typically have a fluorine content in an amount of about 66 weight percent. Type 2 FKMs are composed of VDF, HFP, and tetrafluoroethylene (TFE) and typically have a fluorine content of about 68 to about 69 weight percent. Type 3 FKMs are composed of VDF, TFE, and perfluoromethylvinylether (PMVE) and typically have a fluorine content of about 62 wt % to about 68 wt %. Type 4 FKMs are composed of propylene, TFE, and VDF and typically have a fluorine content of about 67 weight percent. Type 5 FKMs are composed of VDF, HFP, TFE, PMVE, and Ethylene. The FFKM elastomers are the elastomeric form of poly(tetrafluoro ethylene) or PTFE. Such are copolymers of tetrafluoroethylene and a perfluorinated ether, e.g., perfluoromethylvinylether (PMVE). The fluorine content can vary, depending on the type of the ether.

In some embodiments, the elongated seals 210, 310, 410 can be installed within the bore 109 defined by the elongated body 105 during connection of the first section 115 and the second section 125 to one another. For example, the first end 213 of the elongated seal 210 or the first end 421 of the first section 420 of the elongated seal 410 can be inserted into the bore 109 defined by the first section 115 of the elongated body 105. The second section 125 of the elongated body 105 can then be coupled to the first section 115 of the elongated body 105. As shown, a threaded connection can be used, however, any other suitable connection mechanism can be used. In other embodiments, the second end 215 of the elongated seal 210 or the second end 423 of the first section 420 of the elongated seal 410 can be inserted into the bore 109 defined by the second section 125 of the elongated body 105. The first and second sections 115, 125 can then be coupled to one another. In another example, the elongated seal 310 can be installed within the bore 109 defined by the second section 125 either before or after coupling the first section 115 to the second section 125 has been carried out. As long as the elongated seals 210, 310, 410 are inserted within the bore 109 defined by the elongated body 109 after coupling the first, second, and third sections 115, 125, 135 together to form the elongated body 105, any sequence of arriving at the elongated body 105 can be used in assembling the elongated body 105. Once the elongated body 105 has been assembled, the wireline 111 can be inserted and passed through the bore 211, 311, 411 defined by the elongated seals 210, 310, 410 and the bore 109 defined by the elongated body 105 such that the wireline 111 passes completely through the elongated body 105.

Figure 5:
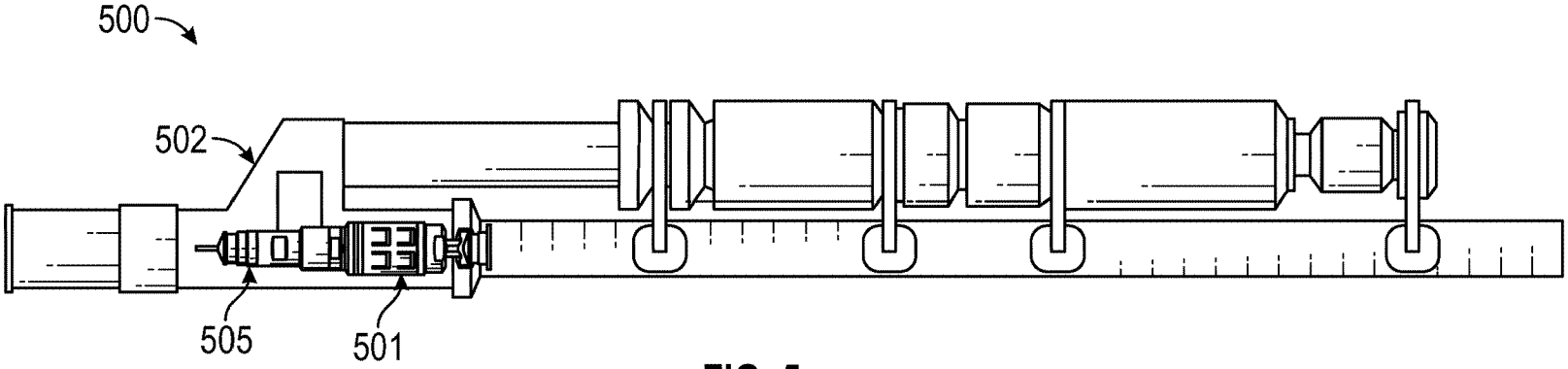
FIG. 5 depicts an illustrative Y-tool that includes a wireline plug disposed therein, according to one or more embodiments described.

FIG. 5 depicts an illustrative Y-tool 500 that includes a wireline plug 505 disposed therein, according to one or more embodiments. In some embodiments, wireline plug 505 can be any one of the wire line plugs 200, 300, and 400 described above with reference to FIGS. 2-4. The Y-tool 500 can include a first conduit 501 and a second conduit 502. The first conduit 501 can be concentric with a production tubing the Y-tool 500 can be connected to. The second conduit 502 can be offset and can house an electrical submersible pump therein. As such, the Y-tool 500 can permit the electrical submersible pump to operate while simultaneously carrying out one or more downhole operations, e.g., a logging operation, via one or more downhole tool (150, see FIG. 1) that can be connected to and suspended from the second end 108 of the wireline plug 500 and disposed within a wellbore below the electrical submersible pump. The elongated seal, e.g., 210, 310, or 410, that can be disposed within the wireline plug 500 can reduce or prevent damage to the outer surface or jacket 112 of the wireline 111 as the wireline 111 passes therethrough.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is intended to cover all modifications, equivalents, and alternatives falling within the spirit and scope of the present disclosure as defined by the following appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A wireline plug for use in a Y-tool, comprising:

an elongated body defining a bore therethrough, wherein a first end of the elongated body comprises an outer surface configured to serve as a fishing neck and a second end configured to connect to a downhole tool, wherein:

the elongated body comprises a first section, a second section, and a third section, the first section comprises the first end of the elongated body and a second end coupled to a first end of the second section, a second end of the second section is coupled to a first end of the third section, and a second end of the third section comprises the second end of the elongated body; and an elongated seal defining a bore therethrough disposed within a portion of the bore defined by the elongated body, wherein:

the elongated seal is configured to provide an at least partial fluid seal between an inner surface of the bore defined by the elongated body and an outer surface of a wireline when disposed within the bore defined by the elongated seal, wherein the elongated seal is formed from a polymer, an elastomer, or at least a first section of the elongated seal is formed from a polymer and at least a second section of the elongated seal is formed from an elastomer, a first end of the first section of the elongated seal is located within the first section of the elongated body, a second end of the first section of the elongated seal is located with the second section of the elongated body, the second section of the elongated seal is located within the second section of the elongated body, and a first end of the second section of the elongated seal is adjacent the second end of the first section of the elongated seal, wherein:

the first section of the elongated seal comprises a circumferential wall extending radially about the first section of the elongated seal between the first end and the second end of the first section of the elongated seal, and at least a portion of the circumferential wall is disposed between an inner wall of the first section of the elongated body and the first end of the second section of the elongated body.

2. The wireline plug of claim 1, wherein the second end of the elongated body is configured to connect to a fishing neck of the downhole tool.

3. The wireline plug of claim 1, wherein:

the elongated seal is formed from a polymer, a first end of the elongated seal is located within the first section of the elongated body, and a second end of the elongated seal is located with the second section of the elongated body.

4. The wireline plug of claim 3, wherein:

the elongated seal comprises a circumferential wall extending radially about the elongated seal between the first end and the second end of the elongated seal, and at least a portion of the circumferential wall is disposed between an inner wall of the first section of the elongated body and the first end of the second section of the elongated body.

5. The wireline plug of claim 3, wherein a wall thickness of the elongated seal between the first end of the elongated seal and the circumferential wall is less than a wall thickness of the elongated seal located between the circumferential wall and the second end of the elongated seal.

6. The wireline plug of claim 1, wherein:

the elongated seal is formed from an elastomer, a first end of the elongated seal is located between an inner wall of the first section of the elongated body and the first end of the second section of the elongated body, and a second end of the elongated seal is located within the second section of the elongated body.

7. The wireline plug of claim 6, wherein the elongated seal is a single seal or a split seal.

8. The wireline plug of claim 1, wherein a wall thickness of the first section of the elongated seal between the first end of the first section of the elongated seal and the circumferential wall is less than a wall thickness of the first section of the elongated seal located between the circumferential wall and the second end of the first section of the elongated seal.

9. The wireline plug of claim 1, wherein the second section of the elongated seal comprises a single seal or a split seal.

10. The wireline plug of claim 1, wherein:

the elongated seal further comprises a third section formed from a polymer, the third section of the elongated seal is located within the second section of the elongated body, and a first end of the third section is located adjacent a second end of the second section of the elongated seal.

11. The wireline plug of claim 10, wherein the first section and the third section of the elongated seal are formed from the same polymer or different polymers with respect to one another.

12. The wireline plug of claim 1, wherein the inner surface of the bore defined by the elongated body is formed from a metal.

13. The wireline plug of claim 1, wherein, if the elongated seal or a section thereof is formed from a polymer, the polymer comprises a polyether ether ketone, a polyaryl ether ketone polymer, a polyphenylene sulfide polymer, an ethylene-tetrafluoroethylene polymer, a poly (1,4-phenylene) polymer, a polytetrafluoroethylene polymer, a perfluoroalkoxy polymer, a fluorinated ethylene propylene polymer, a perfluoromethoxy polymer, other suitable polymeric materials, and any combination thereof.

14. The wireline plug of claim 13, wherein the elongated seal or a section thereof is formed from the polymer, wherein the polymer comprises the polyether ether ketone, and wherein the polyether ether ketone comprises a virgin polyether ether ketone, a carbon-fiber-reinforced polyether ether ketone, glass fiber reinforced polyether ether ketone, a lubricated polyether ether ketone, or a combination thereof.

15. The wireline plug of claim 1, wherein, if the elongated seal or a section thereof is formed from an elastomer, the elastomer comprises a hydrogenated acrylonitrile butadiene rubber, a fluorocarbon-based fluoroelastomer, a polychloroprene elastomer, a fluoro-elastomer, a perfluoro-elastomer, a tetrafluoro ethylene/propylene rubber, a fluorosilicone rubber, a nitrile butadiene rubber, a saturated nitrile butadiene rubber, a silicone rubber, a polyurethane elastomer, or a combination thereof.

16. The wireline plug of claim 15, wherein the elongated seal or a section thereof is formed from an elastomer, the elastomer comprises a hydrogenated acrylonitrile butadiene rubber, a fluorocarbon-based fluoroelastomer, or a combination thereof, and wherein the fluorocarbon-based fluoroelastomer, if present, comprises one or more of the fluorocarbon-based fluoroelastomers defined by ASTM D1418-22.

17. A process for assembling a wireline plug, comprising:

installing an elongated seal within a bore defined by an elongated body, wherein a first end of the elongated body comprises an outer surface configured to serve as a fishing neck and a second end configured to connect to a downhole tool, wherein:

the elongated seal defines a bore therethrough, the elongated seal is located within a portion of the bore defined by the elongated body, the elongated seal is configured to provide an at least partial fluid seal between an inner surface of the bore defined by the elongated body and an outer surface of a wireline when disposed within the bore defined by the elongated seal, the elongated seal is formed from a polymer, an elastomer, or at least a first section of the elongated seal is formed from a polymer and at least a second section of the elongated seal is formed from an elastomer, wherein:

a first end of the first section of the elongated seal is located within the first section of the elongated body, a second end of the first section of the elongated seal is located with the second section of the elongated body, the second section of the elongated seal is located within the second section of the elongated body, and a first end of the second section of the elongated seal is adjacent the second end of the first section of the elongated seal, wherein:

the first section of the elongated seal comprises a circumferential wall extending radially about the first section of the elongated seal between the first end and the second end of the first section of the elongated seal, and at least a portion of the circumferential wall is disposed between an inner wall of the first section of the elongated body and the first end of the second section of the elongated body.

18. The process of claim 17, further comprising passing a wireline through the bore defined by the elongated seal and the bore defined by the elongated body such that the wireline passes completely through the elongated body.

* * * * *